US006231251B1

(12) United States Patent
Clark

(10) Patent No.: US 6,231,251 B1
(45) **Date of Patent: *May 15, 2001**

(54) PRINTING APPARATUS WITH A PRINTHEAD ROTATABLE BETWEEN A PRINTING POSITION AND A SERVICE POSITION

(75) Inventor: David Clark, Hertfordshire (GB)

(73) Assignee: Allen Coding Systems Limited, Hertfordshire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,469

(22) Filed: Feb. 11, 1999

(30) Foreign Application Priority Data

Feb. 13, 1998 (GB) ..... 9803153

(51) Int. Cl.[7] ..... B41J 29/02; B41J 32/00
(52) U.S. Cl. ..... 400/356; 400/693; 400/208
(58) Field of Search ..... 400/223, 229, 400/207, 208, 356, 692, 691, 693, 693.1

(56) References Cited

U.S. PATENT DOCUMENTS

| | | | | |
|---|---|---|---|---|
| 4,493,252 | * | 1/1985 | Clark | 400/96 |
| 4,685,815 | | 8/1987 | Baranyi | 400/125.1 |
| 4,778,290 | * | 10/1988 | Costa et al. | 400/208 |
| 5,044,801 | * | 9/1991 | Uchimura et al. | 400/692 |
| 5,138,335 | * | 8/1992 | Sugimoto et al. | 400/236 |
| 5,366,302 | | 11/1994 | Masumura et al. | 400/120.16 |

FOREIGN PATENT DOCUMENTS

| | | |
|---|---|---|
| 0 413 358 A2 | 2/1991 | (EP) . |
| 0 628 417 A2 | 12/1994 | (EP) . |
| 2204834 | 11/1988 | (GB) . |
| 62-187060 | 8/1987 | (JP) . |

* cited by examiner

*Primary Examiner*—Daniel J. Colilla
(74) *Attorney, Agent, or Firm*—Wood, Herron & Evans, LLP

(57) ABSTRACT

A printing apparatus comprises a print head and foil feed means provided on a mount for feeding foil past the print head when the mount is in a feed position adjacent the print head. The print head is operable to transfer ink from the foil onto a recording medium for generating printed matter on the recording medium. The print head is movable relative to the body of the apparatus between a printing position at which printing is effected and a user accessible position spaced therefrom. The apparatus is configured so that the mount can be withdrawn away from the print head with the withdrawal operation causing the print head to move from the printing postiion to the accessible position.

6 Claims, 7 Drawing Sheets

PRINTING APPARATUS WITH A PRINTHEAD ROTATABLE BETWEEN A PRINTING POSITION AND A SERVICE POSITION

This invention relates to printing and in particular to a mechanism for enabling a user to readily access the print head of a printer. It is applicable to all types of printers but is especially suitable for thermal printers.

There are many different types of printing apparatus but a large majority have the common feature that the printing operation is effected by urging a print head towards a recording medium. The printing may be direct if the recording medium is in the form of, for example, thermally sensitive paper or it may be indirect in which case an ink foil or ribbon is interposed between the print head and the recording medium.

The use of thermal printers has become increasingly common in recent years. Both direct and indirect thermal printers are known. In each case the print head includes a plurality of heat generating elements which are selectively energiseable. In direct thermal printers the print head is brought into contact with a heat-sensitive recording medium, the energised elements causing local portions of the recording medium to be blackened or otherwise coloured. In indirect thermal printers the print head is brought into contact with a thermal ink foil having a thermally fusible ink layer which is pressed by the print head against the surface of the recording medium, the energised elements causing local portions in the ink layer to be transferred to the recording medium.

A particularly common application for indirect thermal transfer printing is for overprinting of relevant customer information on packaging used in the food and drink industry and on pharmaceutical products. The ink foil has a carbon deposit on one side. The application of heat by the energised elements of the print head causes a transfer of carbon from the film onto the substrate to be printed.

Each print head has a finite lifetime, and therefore it is necessary to replace it periodically, as and when the print head fails. In a known printer, the replacement process is time-consuming, as it is necessary to unscrew and remove part of the printer housing, uncouple the ink foil from around the head and then remove mounting screws from the print head itself. These steps must then be carried out in reverse to install the new print head. This printer "downtime" significantly reduces its productivity and efficiency.

The present invention provides a printing apparatus comprising a print head and foil feed means provided on a mount for feeding foil past the print head when the mount is in a feed position adjacent the print head, the print head being operable to transfer ink from said foil onto a recording medium for generating printed matter on the recording medium, wherein the print head is movable relative to the body of the apparatus between a printing position at which printing is effected and a user accessible position spaced therefrom, wherein the apparatus is configured such that the mount can be withdrawn away from the print head, and wherein the withdrawal operation causes the print head to move from the printing position to the accessible position.

Thus, the printer is configured such that the foil feed means and its mount are withdrawn and the print head moved to an accessible position in one action, enabling a user to gain access to the print head readily and efficiently. The print head accessible position is such as to enable it to be readily cleaned or replaced by a user.

The mount may be selectively removable from the body of the apparatus.

Preferably, the print head is rotatable about an axis fixed relative to the body of the apparatus to move from the printing position to the accessible position.

The print head may be rotatable with the foil feed mount during the withdrawal operation, and the rotation may preferably be such as to cause the print head to move from the printing position in contact with said foil to a position spaced from said foil. As a result, the mount can be readily removed, as the print head is spaced from the foil path when the mount is replaced, the print head being then brought back into contact with the foil by reversal of the rotation.

Preferably, a releasable latch is provided which retains the print head in the user accessible position.

Furthermore, the print head may be mounted on a cartridge, the cartridge being selectively removable from the body of the apparatus. The print head can thus be readily replaced by a user.

In another preferred arrangement, the print head is connected to support rods via a mounting block, the mounting block being slidably mounted on the support rods. The position of the print head relative to the recording medium is therefore adjustable by moving the mounting block along the support rods. To minimise the space occupied by the apparatus, control circuitry may be housed within the mounting block.

The invention will now be described by way of example and with reference to the accompanying drawings wherein:

FIG. 1 shows a perspective view of a printer in accordance with the invention;

FIGS. 2*a* and 2*b* show front views of the print unit of the printer of FIG. 1, in a printing and a user accessible position, respectively;

FIGS. 3*a* to 3*f* show a front view of the print unit as it moves from the printing position to the user accessible position;

FIGS. 4*a* and 4*b* show a front view and a rear view of a grip and mounting member of the printer of FIG. 1 when the print unit is in the printing position;

FIGS. 5*a* and 5*b* show a front view and a rear view of a grip and mounting member of the printer of FIG. 1 when the print unit is in the accessible position;

FIG. 6 shows a rear view of the printer of FIG. 1;

FIG. 7*a* and 7*b* show a mounting member of a preferred embodiment of the printer of FIG. 1;

Figure 1:
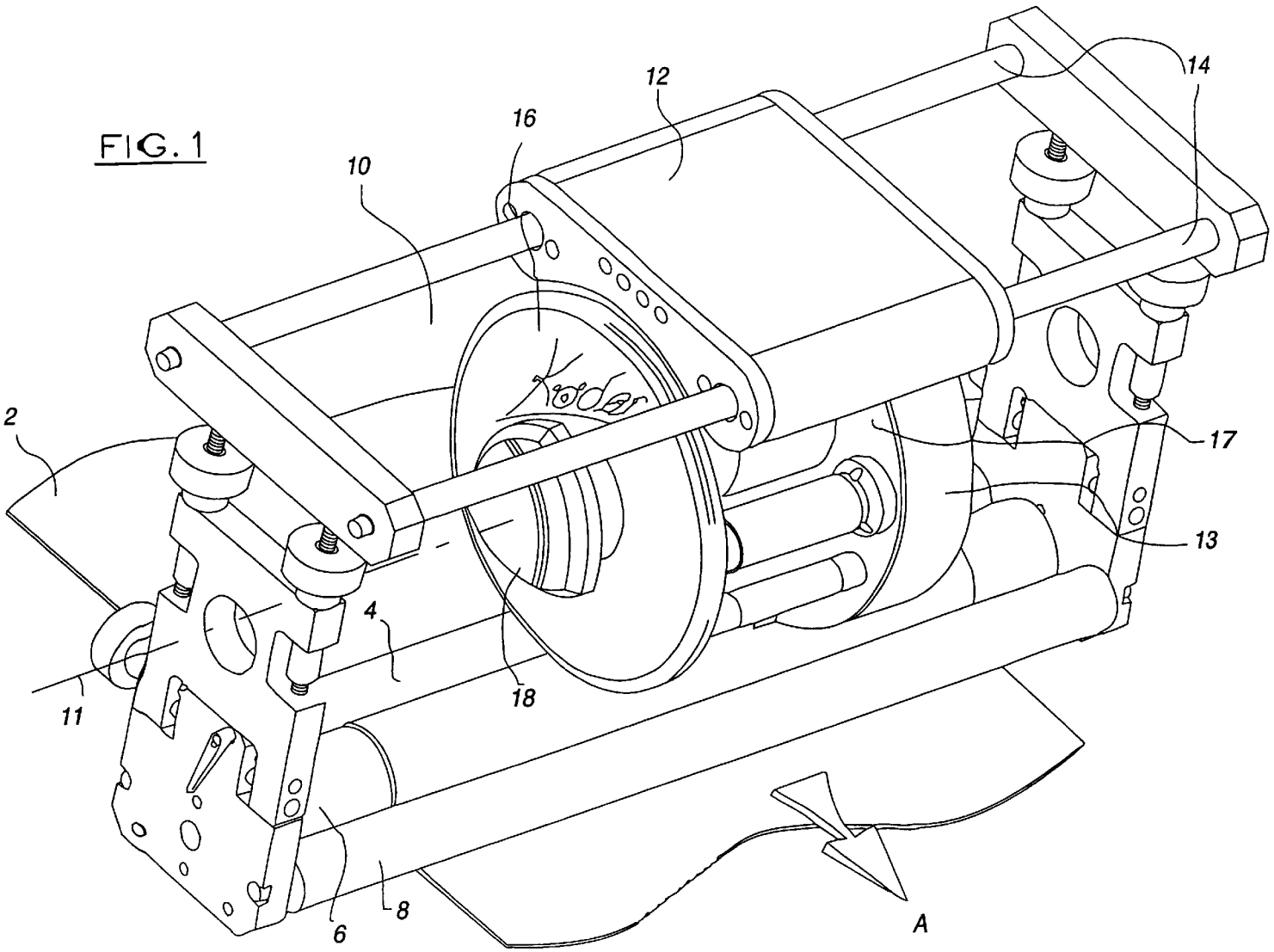

In the printer illustrated in FIG. 1, the sheet material 2 to be printed passes under a first feed roller 4, over support roller 6 and then under a second roller 8. A printing carriage 10 having a central axis 11 is attached to a mounting block 12 which is slidably mounted on the parallel rods 14. A print head (not shown) is mounted in the printing carriage 10 between outer hub 13 and a magazine 16 on a support plate 17. Means for feeding an ink foil past the head are mounted on the inner surface of the magazine 16. A hand grip 18 is provided on the front surface of the magazine.

In use of the printer, as the sheet material 2 is fed in the direction of arrow A, the print head is selectively lowered towards roller 6 pressing the ink foil against the sheet material. Heat generating elements within the head are selectively energised to transfer ink from the foil to the sheet material 2.

Figure 2B:
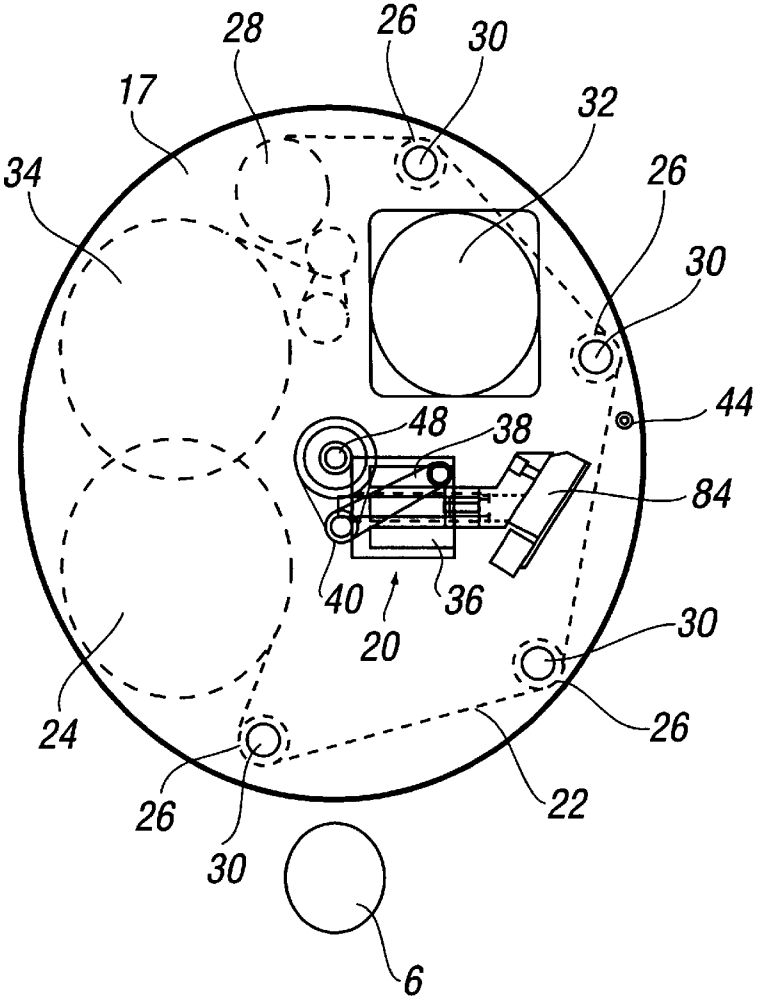
Figure 2A:
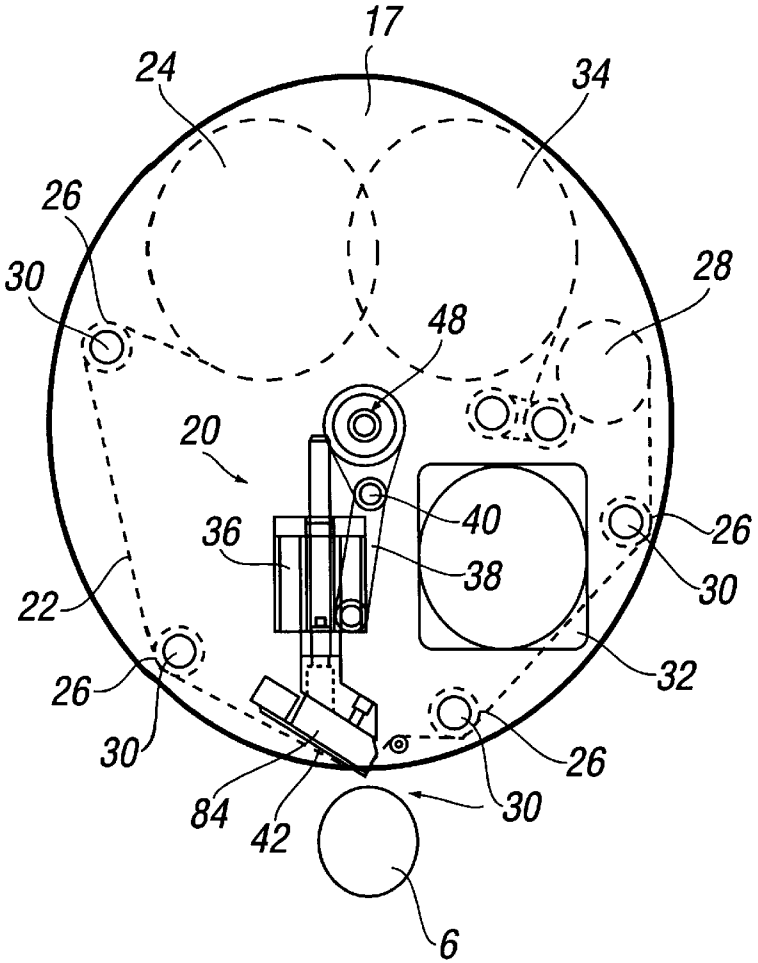

FIGS. 2*a* and 2*b* show printing unit 20 mounted on the support plate 17 as viewed from the magazine 16. Features shown by dotted lines are provided on the magazine. Ink foil 22 is supplied from a feed on spool 24 and passes round feed rollers 26 to a drive roller 28. Each feed roller receives a pin 30 mounted on the support plate 17. The drive roller 28 is rotatable by drive motor 32, and feeds the foil 22 into a take up spool 34. The print unit 20 comprises a print arm 36 pivotally mounted to crank 38 which is in turn pivotal about joint 40.

In FIG. 2*a*, the print head 84 is in the printing position. The foil 22 passes over the undersurface 42 of the head and around pin 44. The print head profile shown is particularly advantageous as it creates an appropriate foil stripping angle. That is, the foil is drawn directly away from the material to be printed so as to prevent adherence therebetween.

The magazine 16 is removable to separate the foil feeding mechanism from the print unit 20 and thus allow access to the print head 84. The removal process (described in detail below) involves rotation of the magazine 16 together with support plate 17 through approximately 90° about point 46 on axis 11 to the orientation shown in FIG. 2*b*. It can be seen that the printing unit 20 is rotated and drawn clear of the foil path. The magazine 16 can then be removed to expose the print head 84, so it can be cleaned or replaced as appropriate. As the print head is positioned clear of the foil path, the magazine 16 can be replaced without risk of snagging the foil 22 on the print head. Rotation of the magazine 16 and support plate 17 back to the orientation shown in FIG. 2*a* returns the print head 84 into engagement with the foil 22. In this way the print head can be reliably returned to a position close to the support roller 6, preferably spaced about 1 mm therefrom. The amount of print head travel required during a printing operation is therefore minimised.

FIGS. 3*a* to 3*f* illustrate how this print head movement is achieved. The axis point 46 and pivot joint 40 are fixed in position relative to the printer. A support member 48 is mounted to and so rotates with support plate 17. The support member carries a pair of rods 50 (only one shown) along which the print arm 36 can slide.

Figure 3A:
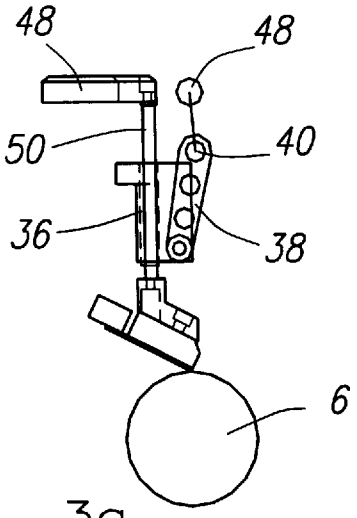
Figure 3B:
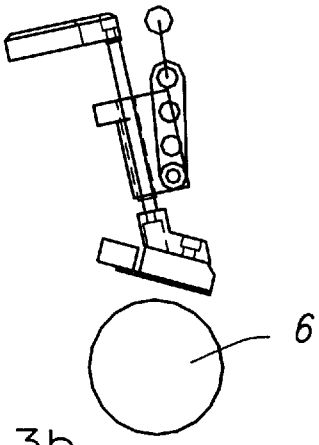
Figure 3C:
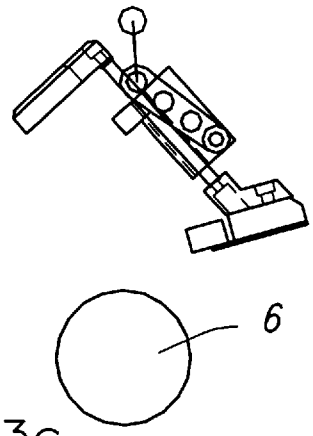
Figure 3D:
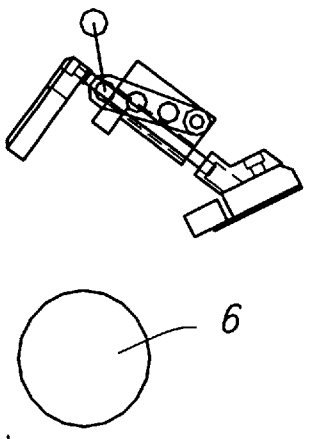
Figure 3E:
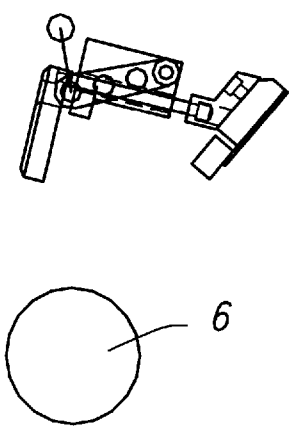
Figure 3F:
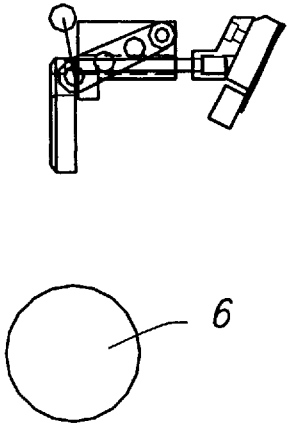

As the magazine 16 and support plate 17 are rotated, support member 48 rotates around the point 46. Crank 38 acts to draw the print arm 36 along rods 50, until the accessible orientation shown in FIG. 3*f* is finally reached.

Figure 5B:
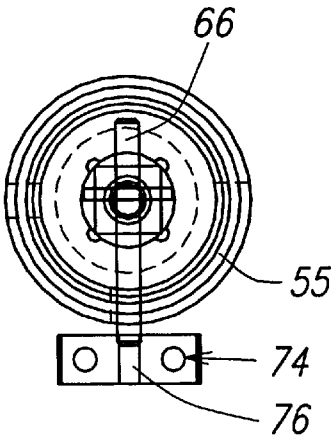
Figure 5A:
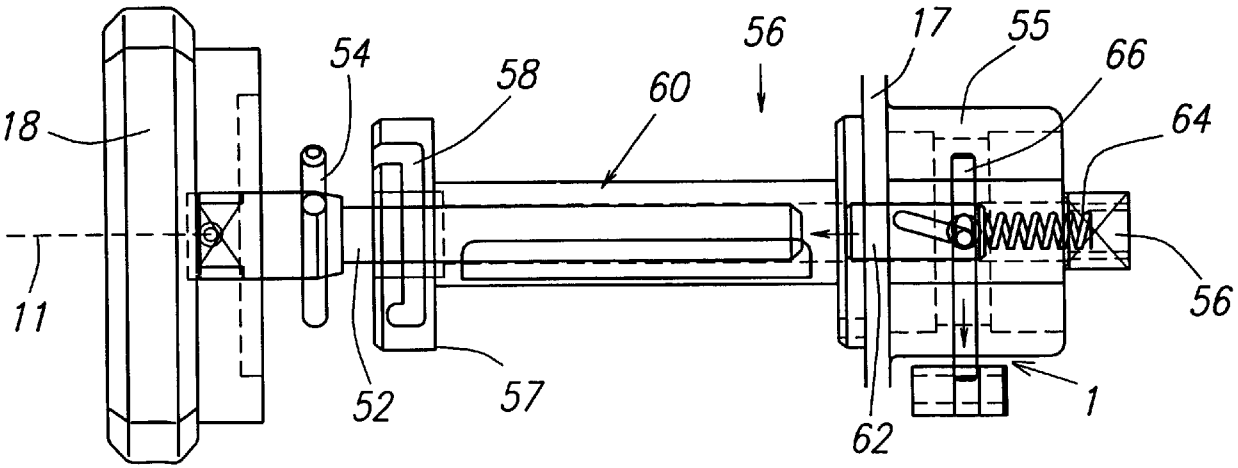
Figure 6:
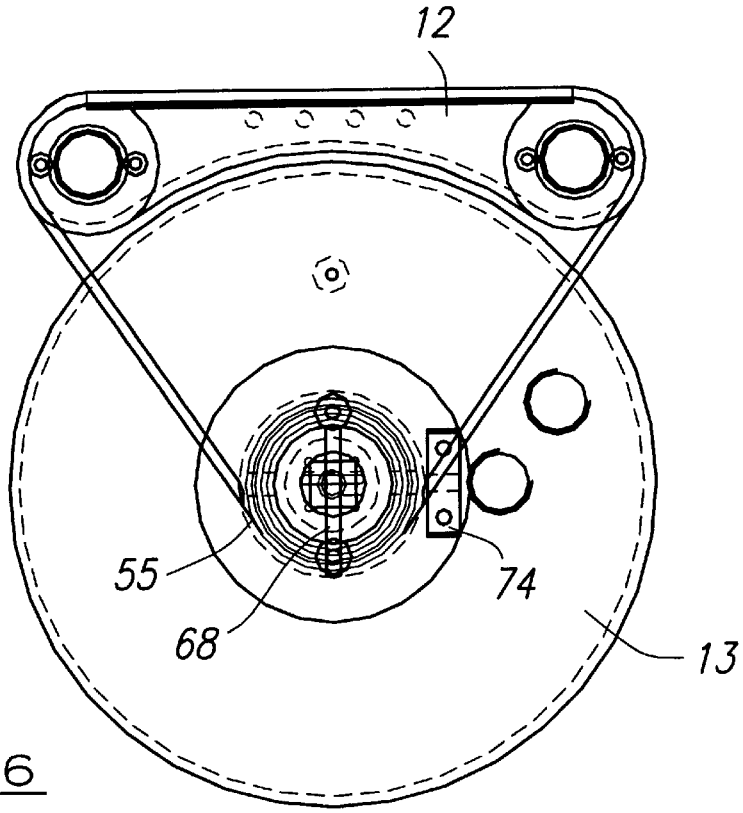

FIGS. 4 to 6 show a mechanism operable to retain the print head in the accessible position and prevent it from returning towards the print position under the force of gravity.

An engaging pin 52 is fixed to the grip 18 of the magazine 16 (not shown) and carries locator pin 54. A locking member 56 which is fixed in position relative to the printer comprises a collar 57 with a bayonet slot 58 carried on one end of a sleeve 60. The sleeve 60 passes through support plate 17 and inner hub 55 which rotates with the support plate 17. A slidable plunger 62 is provided at the other end of the locking member 56 and is biased towards the left of FIGS. 4*a* and 5*a* by a spring 64. A latch pin 66 is also slidably mounted within the locking member 56 transversely to the collar 60 and carries a cam pin 68. The cam pin is movable along slots 70 and 72 formed in the plunger 62 and locking member 56, respectively. A block 74 is mounted on the rear surface of support plate 17 (see FIG. 6) and has an aperture 76 formed therein for receiving latch pin 66.

Figure 4B:
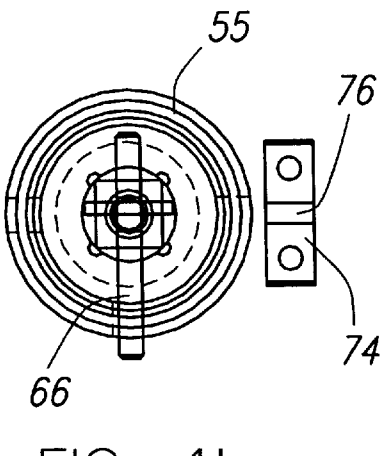
Figure 4A:
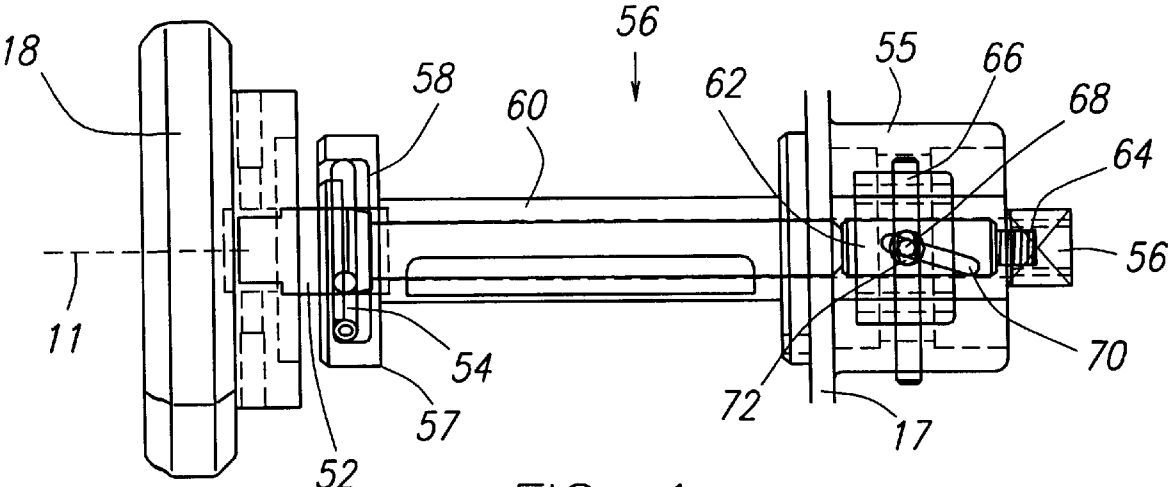

When the magazine 16 is removed from the printer, grip 18 must initially be pushed slightly to the right in FIG. 4*a* against a retaining force exerted by spring 64 to move locator pin 54 into the main part of bayonet slot 58. Grip 18 can then be rotated about axis 11, moving locator pin 54 along bayonet slot 58. This rotation also moves the print head 84 towards its accessible position. In addition, block 74 is rotated with support plate 17 as shown in FIGS. 4*b* and 5*b*. Once the locator pin 54 has reached the position shown in FIG. 5*a*, it can be withdrawn from bayonet slot 58. Engaging pin 52 is also therefore withdrawn within sleeve 60. Spring 64 then moves plunger 62 to the left, urging cam pin 68 along slots 70 and 72. Latch pin 66 is thereby inserted into aperture 76 of block 74, preventing further rotation of the support plate 17 and therefore the printing unit 20.

Figure 7A:
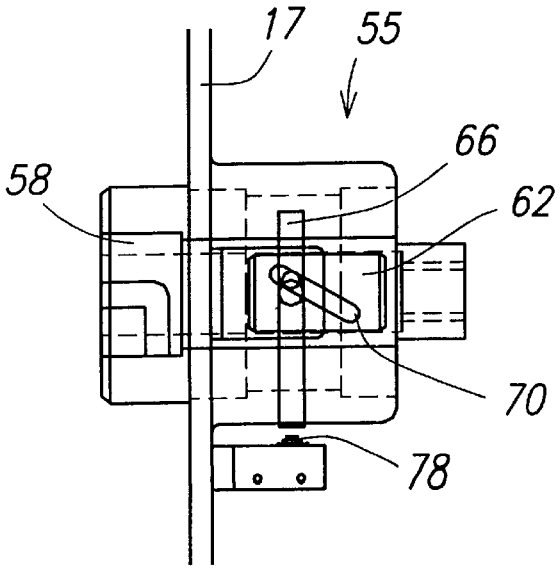
Figure 7B:
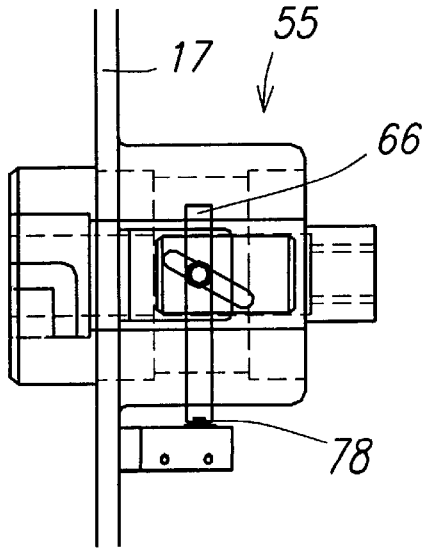

FIGS. 7*a* and 7*b* illustrate a further feature which can be incorporated in the mechanism shown in FIGS. 4 and 5. A microswitch 78 is mounted to support plate 17, at a location displaced about 900 around axis 11 from that of block 74. FIG. 7*b* shows the mechanism in a position corresponding to that of FIGS. 4*a* and 4*b*. In FIG. 7*a*, hub 18 has been pushed slightly to the right, moving locator pin 54 to the right in bayonet slot 58 from its position in FIG. 4*a*. It can be seen that only when locator pin 54 is fully home in bayonet 58 (FIGS. 4*a* and 7*b*) is microswitch 78 engaged by latch pin 66. Accordingly, the printer can indicate to a user when the magazine 16 has been securely replaced. As shown in FIGS. 7*a* and 7*b*, the bayonet slot 58 may alternatively formed in mounting member 56 adjacent support plate 17 to make the mounting member more compact.

Figure 8:
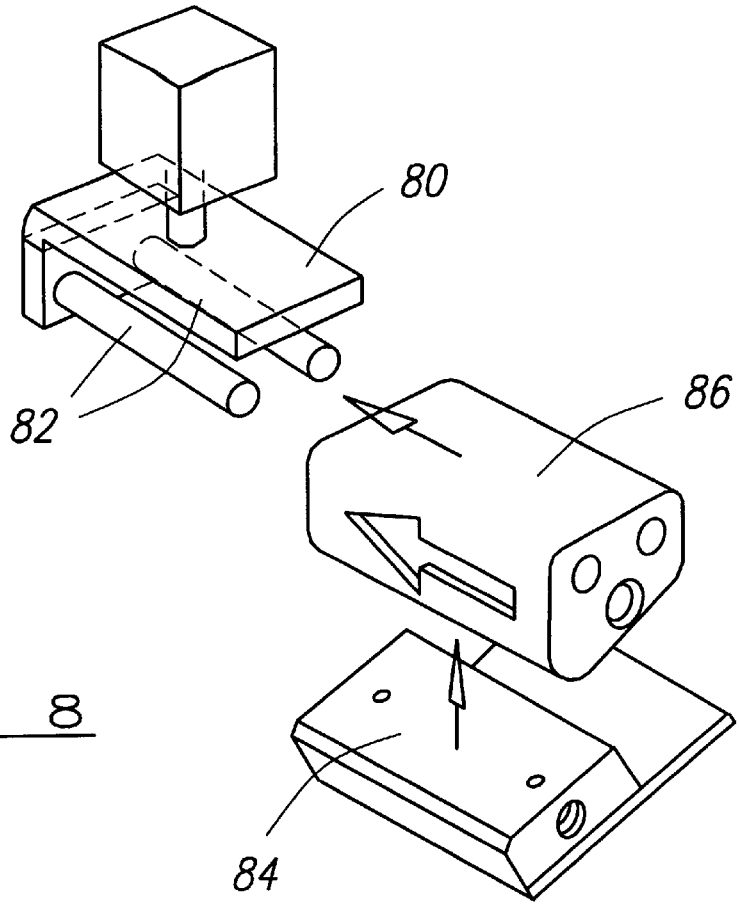
FIG. 8 shows an exploded perspective view of a front loading print cartridge.
Figure 9:
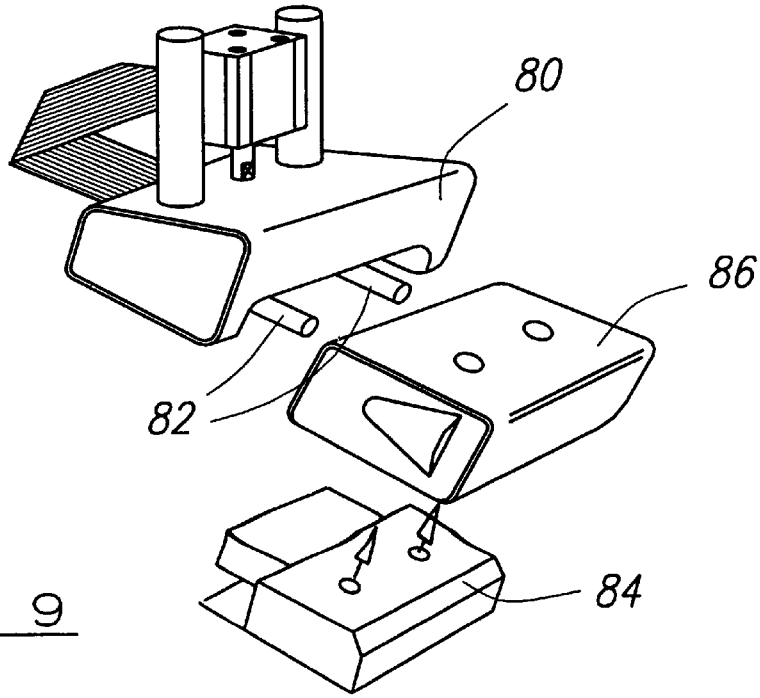
FIG. 9 shows an exploded perspective view of a side loading print cartridge.

FIG. 8 illustrates a quick change front loading cartridge configuration. Mounting element 80 is provided on print arm 36 and includes two mounting rods 82. Print head 84 is fitted into a cartridge 86 which defines two passages 88 for receiving the rods 82. To mount a new cartridge, a user simply has to slide the cartridge 86 onto the rods 82 and tighten a retaining screw (not shown). A similar side loading arrangement is shown in FIG. 9.

Figure 10:
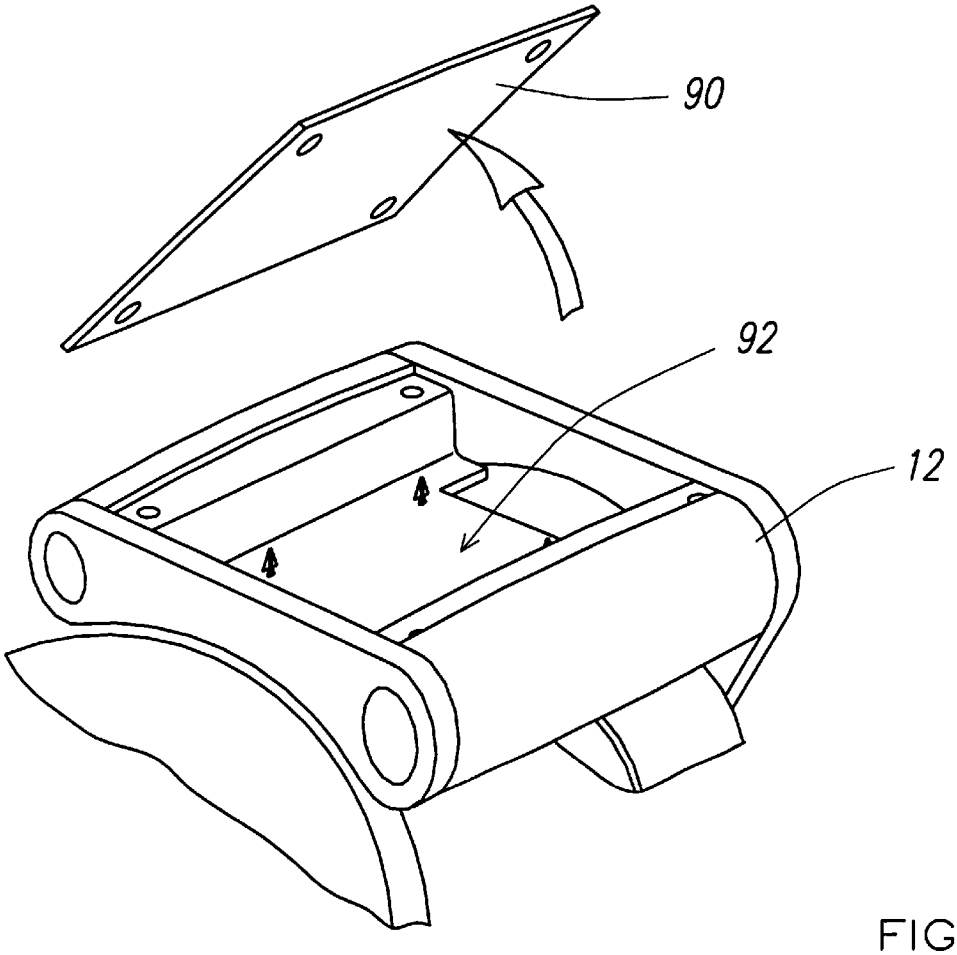
FIG. 10 shows a perspective view of the mounting block of the printer of FIG. 1.

As shown in FIG. 10, mounting block 12 may include a removable plate 90. Control circuitry can be conveniently located within space 92 in the mounting block to minimise the volume occupied by the printer.

What is claimed is:

1. A printing apparatus comprising a print head mounted on a support, a magazine carrying a supply of foil, a link mechanism between the print head and the magazine and foil feed means provided on the magazine for feeding foil past the print head when the magazine is in a feed position and the print head is in a printing position with respect to the print head support, the print head in the printing position being operable to transfer ink from said foil onto a recording medium for generating printed matter on the recording medium, wherein the print head is rotatable relative to the body of the apparatus about an axis fixed relative to the body of the apparatus between the printing position at which printing is affected and a service position spaced therefrom, the print head being readily accessible by a user from the exterior of the apparatus in the service position, wherein the magazine is rotatable about a fixed axis of the apparatus to withdraw it from the print head support and out of the feed position and wherein the link mechanism is operable on rotation of the magazine out of the print position to rotate the print head from the printing position to the service position and the link mechanism is operable on rotation of the magazine into the feed position to rotate the print head from the service position to the printing position.

2. The apparatus of claim 1 wherein the magazine, when withdrawn, is selectively removable from the body of the apparatus.

3. The apparatus of claim 1 wherein the print head is mounted on a cartridge, the cartridge being selectively removable from the body of the apparatus.

4. The apparatus of claim 1 wherein a releasable latching mechanism is provided for latching the print head in the service position.

5. The apparatus as claimed in claim 4 wherein the latching mechanism is operative automatically to latch the print head on movement of the print head to the service position.

6. The apparatus of claim 1 including indicia means for indicating when the mount is in the feed position adjacent the print head.

* * * * *